US009221600B2

(12) United States Patent
Iacobucci

(10) Patent No.: US 9,221,600 B2
(45) Date of Patent: Dec. 29, 2015

(54) SINGLE-COLUMN TRASH COMPACTOR

(75) Inventor: Lucio Iacobucci, Rome (IT)

(73) Assignee: IACOBUCCI HF AEROSPACE S.p.A., Ferentino (IT)

( * ) Notice: Subject to any disclaimer, the term of this patent is extended or adjusted under 35 U.S.C. 154(b) by 229 days.

(21) Appl. No.: 13/698,436

(22) PCT Filed: May 13, 2011

(86) PCT No.: PCT/IT2011/000152

§ 371 (c)(1),
(2), (4) Date: Jan. 17, 2013

(87) PCT Pub. No.: WO2011/145124

PCT Pub. Date: Nov. 24, 2011

(65) Prior Publication Data

US 2013/0206020 A1 Aug. 15, 2013

(30) Foreign Application Priority Data

May 17, 2010 (IT) ..... RM2010A0251

(51) Int. Cl.
*B30B 1/18* (2006.01)
*B65F 1/14* (2006.01)
*B30B 9/30* (2006.01)

(52) U.S. Cl.
CPC ..... *B65F 1/1405* (2013.01); *B30B 1/18* (2013.01); *B30B 1/181* (2013.01); *B30B 9/3064* (2013.01); *B65F 1/1468* (2013.01)

(58) Field of Classification Search
CPC ..... B30B 1/18; B30B 9/3064; B30B 1/181; B65F 1/1405; B65F 1/1468; F02K 1/763; F16H 25/20; F16H 25/2056; F16H 2025/2075
USPC ..... 100/35, 240, 245, 287, 289, 290, 100, 100/229 A; 74/89.35
See application file for complete search history.

(56) References Cited

U.S. PATENT DOCUMENTS 2,971,399 A 2/1961 Roberts
3,404,580 A * 10/1968 Valenti ..... 74/89.35

(Continued)

FOREIGN PATENT DOCUMENTS

DE 2202514 A1 7/1973
DE 2410108 A1 9/1975

(Continued)

OTHER PUBLICATIONS

Petrucci, International Search Report and Written Opinion, PCT/IT2011/000152, European Patent Office, Sep. 2, 2011.

*Primary Examiner* — Jimmy T Nguyen
(74) *Attorney, Agent, or Firm* — Gregory P. Einhorn; Greer Burns & Crain Ltd.

(57) ABSTRACT

An electromechanical, modular, single-column, trash compactor with a particularly small size and low weight. In particular, a trash compaction device which can be used on-board aircraft, trains, ships and/or for civil applications and generally in all the locations and/or modes of transportation where the auxiliary service equipment must occupy as little space as possible. The compaction device is formed by a system of hollow telescopic screws (5,6), for example of the recirculating ball type, operated by a motor (2) housed inside the said screws (5,6). The compactor may be conveniently installed in compartments, which are fixed or movable on wheels, such as a trolley, so as to allow easy displacement within the mode of transportation and insertion within the appropriate working spaces.

18 Claims, 11 Drawing Sheets

(56) References Cited

U.S. PATENT DOCUMENTS

| | | | | | |
|---|---|---|---|---|---|
| 3,727,546 | A * | 4/1973 | McKinney | 100/229 A |
| 3,831,513 | A | 8/1974 | Tashman | |
| 4,651,581 | A * | 3/1987 | Svensson | 74/89.35 |
| 4,870,898 | A * | 10/1989 | Spencer | 100/345 |
| 5,490,455 | A * | 2/1996 | Conti et al. | 100/50 |
| 5,768,988 | A * | 6/1998 | Meloni | 100/229 A |
| 7,552,676 | B1 * | 6/2009 | Johnson | 100/289 |
| 2004/0173041 | A1 * | 9/2004 | Said | 74/89.35 |
| 2005/0268736 | A1 * | 12/2005 | Gaechter | 74/89.23 |

FOREIGN PATENT DOCUMENTS

| | | | |
|---|---|---|---|
| EP | 1449639 | A2 | 8/2004 |
| JP | 52033372 | | 3/1977 |

* cited by examiner

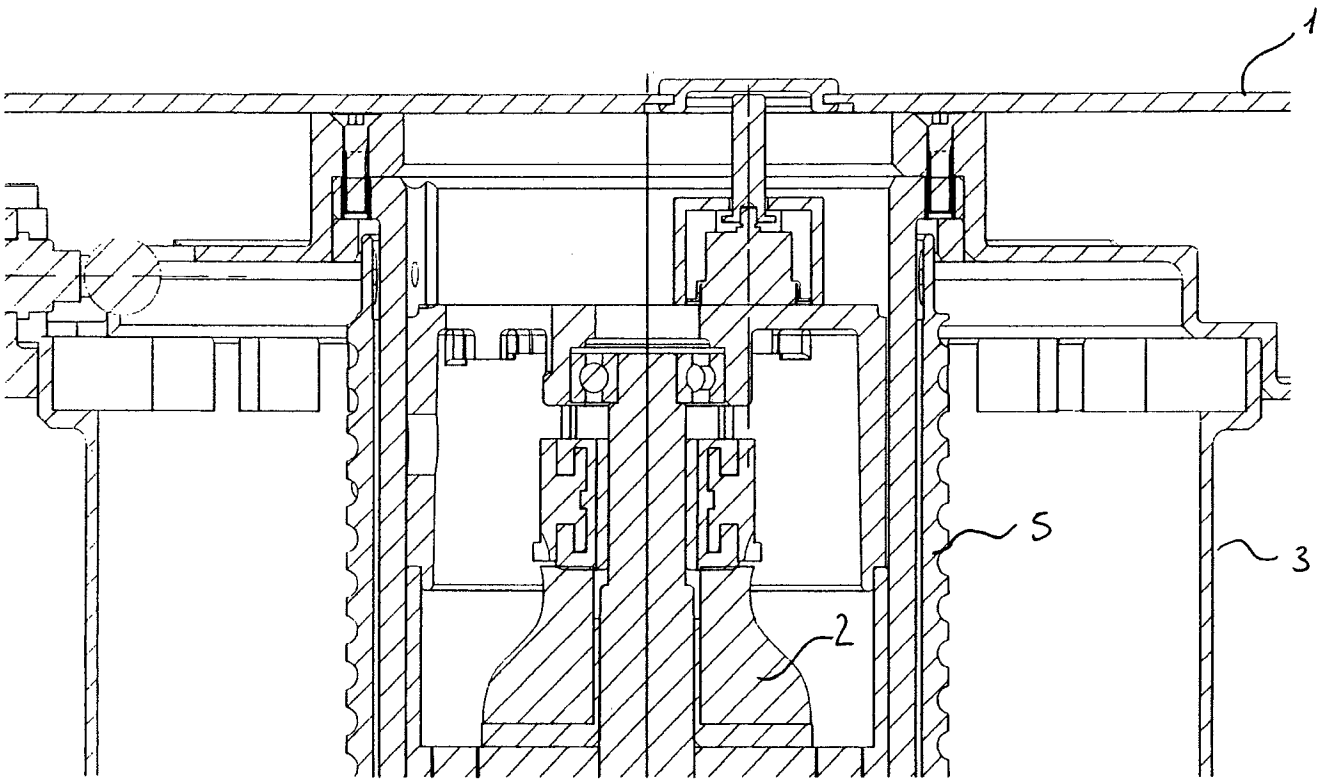
Fig. 6 detail A

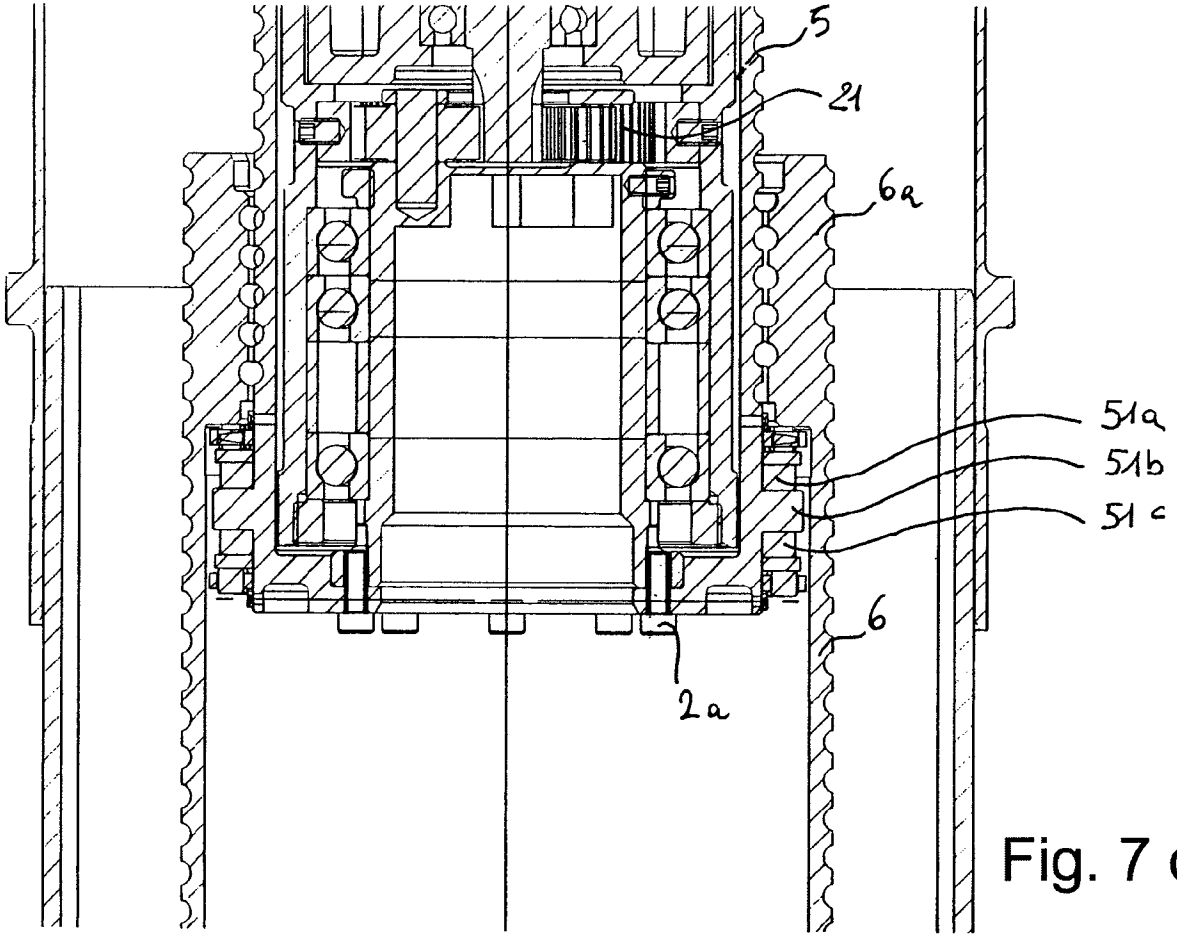
Fig. 7 detali B

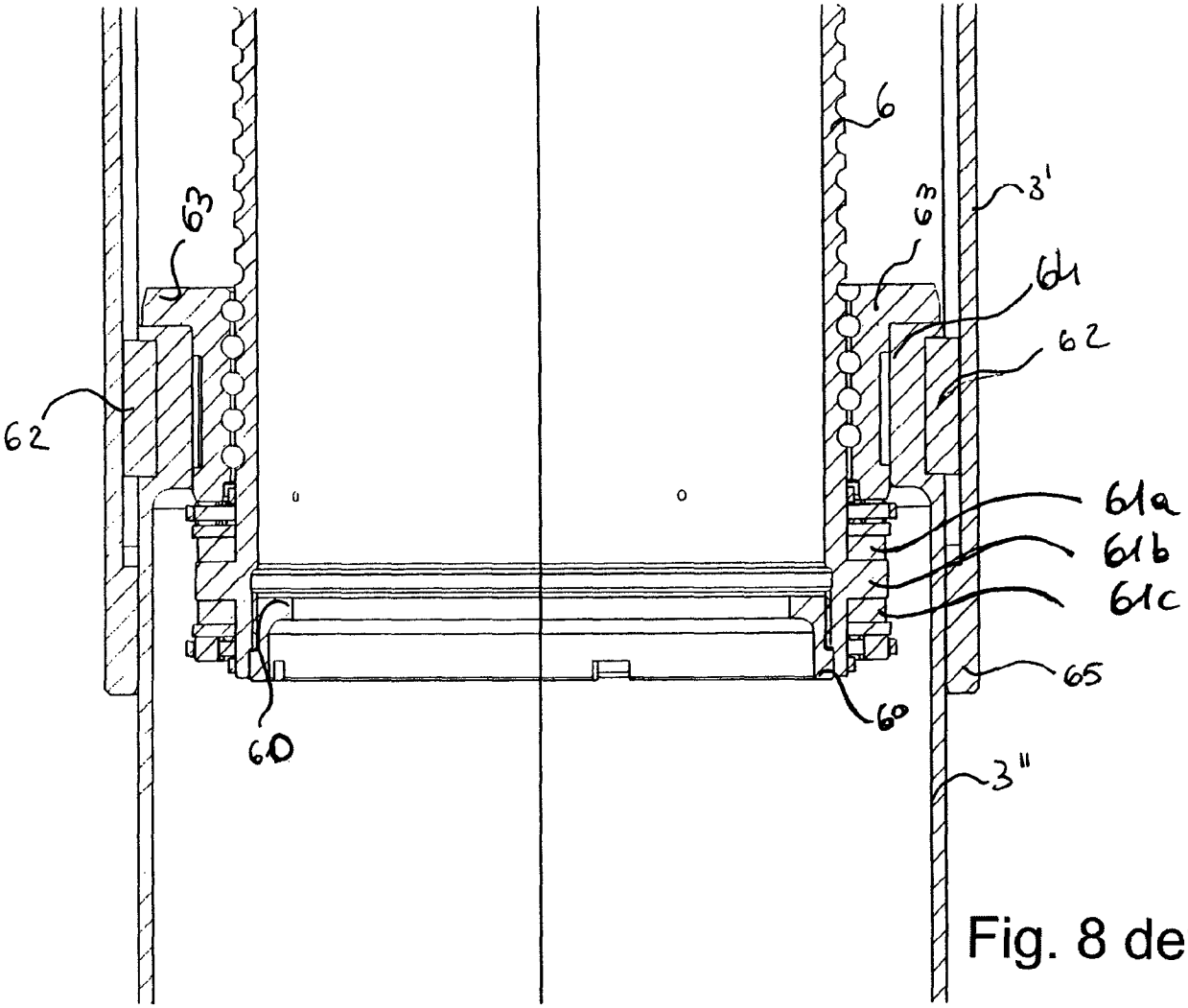
Fig. 8 detail C

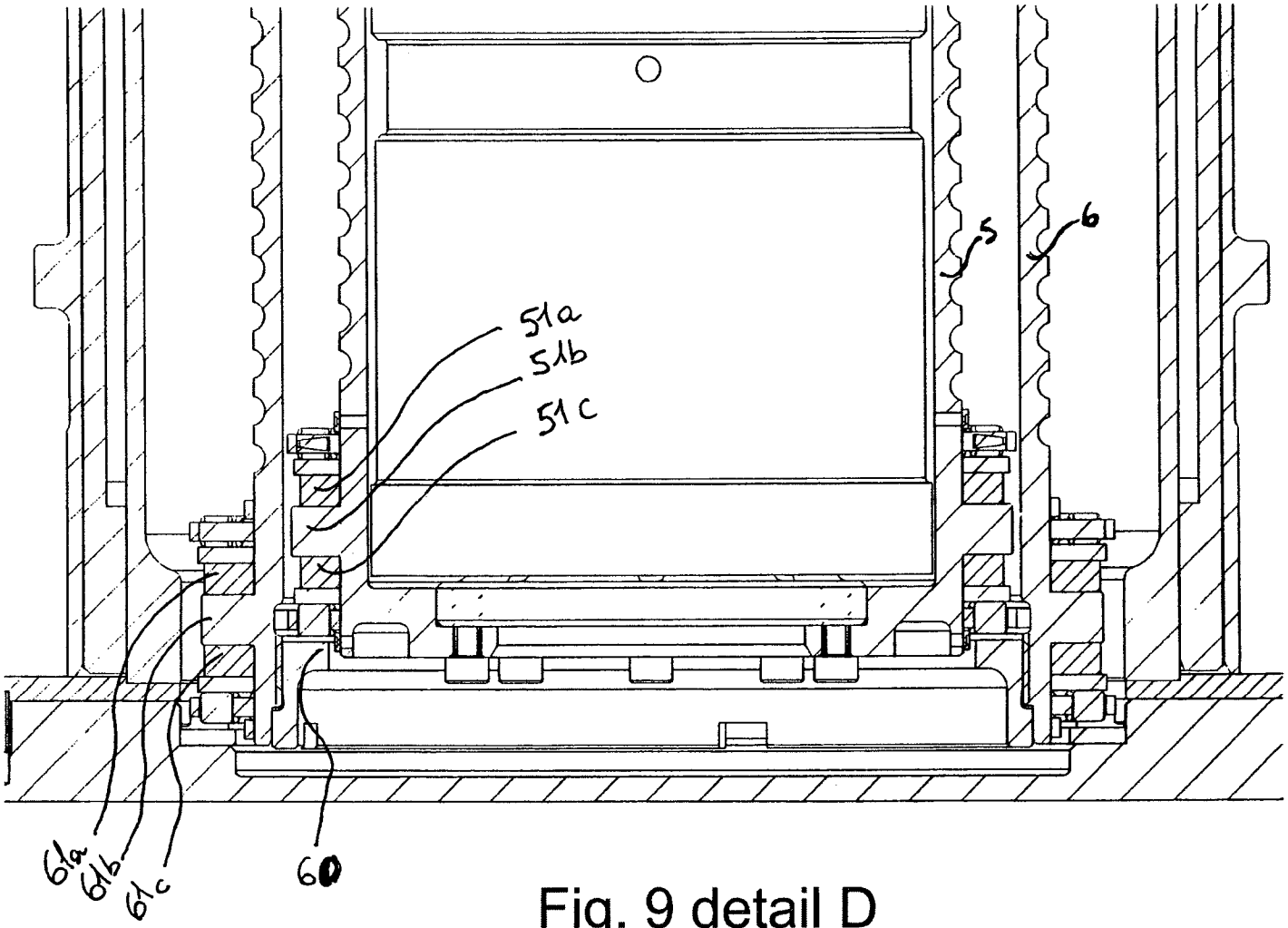
Fig. 9 detail D

SINGLE-COLUMN TRASH COMPACTOR

This application is a national phase patent utility filing under 35 USC §371, for international application no. PCT/IT2011/000152, filed on 13 May 2011, which claims the benefit of priority to Italian patent application serial no. RM2010A000251, filed 17 May 2010. The aforementioned applications are explicitly incorporated herein by reference in their entirety and for all purposes.

FIELD OF THE INVENTION

The present invention relates to an electromechanical, single-column, trash compactor designed with a telescopic screw system, for example, preferably of the recirculating ball type, operated by a motor housed inside screw.

PRIOR ART

The trash compactors used in particular in aircraft must satisfy special requirements as laid down in strict aeronautical regulations. In fact, the accessories installed on civil aircraft must have well-defined structural characteristics and dimensions since they must be able to satisfy a set of harsh requirements imposed by the existing regulations. They must, moreover, be housed and kept fixed safely inside the special compartments provided in the aircraft during flying conditions and must comply with the very strict weight requirement. In fact, a reduction in weight of each piece of accessory equipment on-board an aircraft results in significant savings with regard to fuel costs and management of the aircraft in the long term.

For a long time the compactors were operated by means of hydraulic systems which meant that it was difficult to adapt them for use on-board aircraft. These hydraulic systems in lace increased significantly the volume of the compaction device and resulted in the need for a large amount of electric power, the use of a large quantity of pressurized oil fluid and activation and control systems which are structurally complex and difficult to manufacture and maintain.

Elimination of the hydraulic device has resulted in significant advantages, avoiding the rise of pressurized oil-hydraulic components, which are often the source of undesirable malfunctions and are potentially dangerous on-board an aircraft.

An electromechanical compactor for aircraft is described in U.S. Pat. No. 7,089,852. The compaction device described is based on a horizontal metal plate which is operated by means of an electric motor which operates two telescopic screws. In this system the motor is positioned centrally with respect to the two telescopic screws which are directly connected to it by means of a gearmotor. The same document also describes an aeronautical trolley suitable for housing the compactor.

Although this type of compactor complies with the specific requirements stipulated by the aeronautical regulations, the weight characteristics may be improved, while maintaining substantially the same dimensions. Moreover, the device has the drawback that it must be progressively greased, for which operation it must be removed from the compartment in which it is housed. In addition, the telescopic screws used here must be protected from dirt and this results in the need for periodic maintenance operations.

Moreover, types of cover which may be applied to the compactors may be of the bellow or telescopic type, but both of them give rise to problems. In fact, bellow-type covers, although they have excellent performance features which comply with the aeronautical standards, are subject to rapid wear. On the other hand, telescopic covers require space for assembly, while the use of the compactors is generally confined to small, spaces.

Recirculating ball screws are known, for example as described in US2005/0000309, and consist essentially of threaded screws which are connected to sleeves inside which a train of balls is circulated, these also circulating inside the threading.

SUMMARY OF THE INVENTION

A trash compactor device which proposes to overcome the abovementioned drawbacks by means of the features indicated in the claims and the accompanying drawings has now been devised and forms the subject of the present invention.

The invention relates to a low-weight, modular, single-column, electromechanical trash compactor which is able to produce a considerable compressive force (up to about 2,400 kg or more) to be used on-board transportation means such as aircraft, trains, skips, buses, caravans or for civil applications and generally is all locations and/or transportation means where auxiliary service equipment must occupy a very small amount of space.

In particular the invention refers to a device for trash compacting, which is suitable for use on aircraft and complies with the existing aeronautical regulations. The garbage which can be pressed with this device consists typically, but not solely, of cons, glass or plastic bottles, plastic dishware, aluminum containers for food and beverages, cardboard containers, Tetra Pak containers, etc.

The invention also relates to the combination of the compactor device according to the invention with a trolley which is able to house the compactor device according to the invention and which also allows it to be moved inside the transportation means and to be arranged efficiently inside the specific spaces of the structure for storing the equipment used tor any accessory services, provided in a galley or in a transportation means. The combination of the compactor device according to the invention with a trolley also allows the easy and fast removal of the device for any maintenance activities.

Further features will become clear from the detailed description of the invention below, with reference to preferred embodiments, it being understood, however, that variations are possible without thereby departing from the scope of protection defined by the accompanying claims and with reference to the figures of the accompanying drawings.

BRIEF DESCRIPTION OF THE FIGURES

FIG. 6 relates to the detail of the zone A in FIG. 5;

FIG. 7 relates to the detail of the zone B in FIG. 5;

FIG. 8 relates to the detail of the zone C in FIG. 5;

FIG. 9 relates to the detail of the zone D in FIG. 4;

DETAILED DESCRIPTION OF THE INVENTION

Figure 1A:
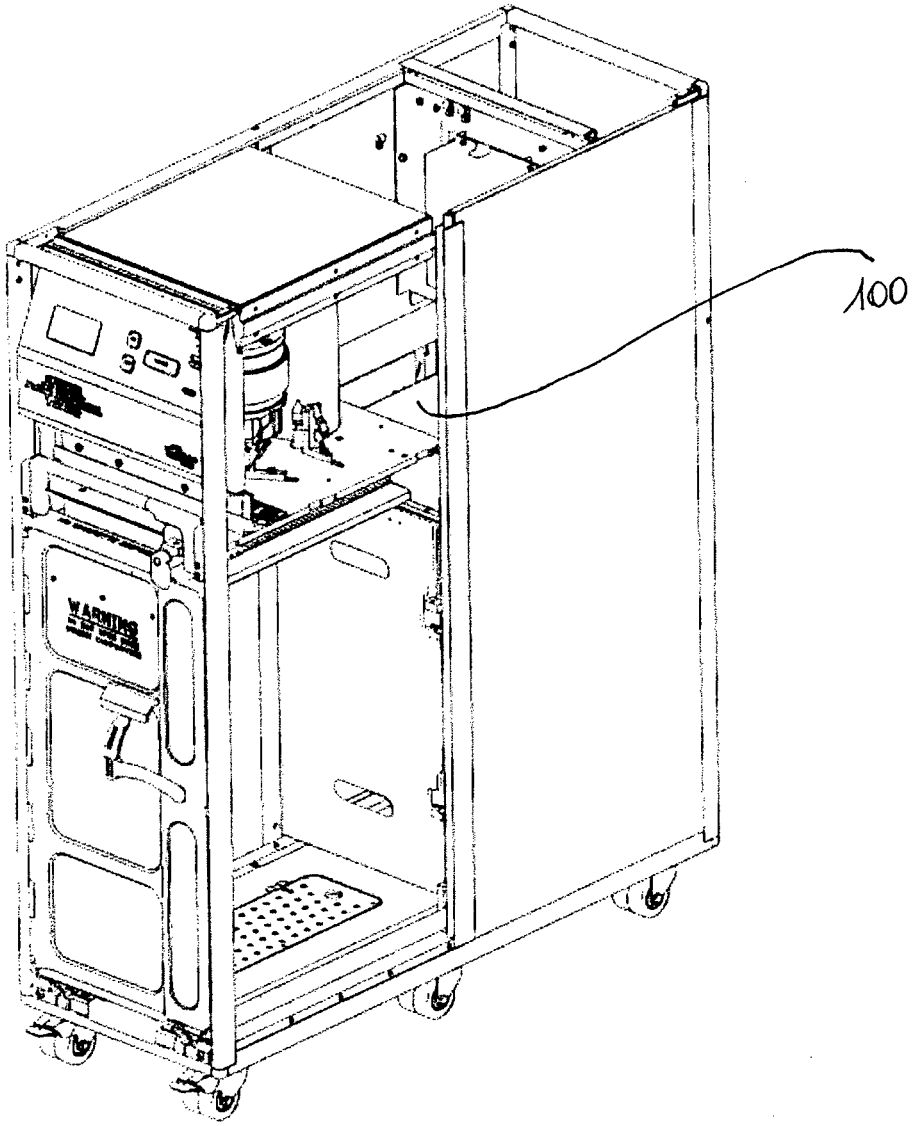
FIG. 1*a* is a schematic perspective view of a trolley used in aircraft, according to the prior art, inside which a conventional compaction device of the electromechanical type with a double telescopic screw may be inserted.

The compaction device according to the invention is of the single-column type, comprising a fixed part 1 for attachment to the carrying structure designed to house it by means of devices known per se, e.g. screws, and a movable compaction plate 4 which moves inside a trash collection compartment (not shown) for performing compaction of the trash. Fixed part 1 and movable plate 4 are connected together by means of a multiple-stage telescopic system for movement of the movable plate 4, preferably a telescopic system with recirculating ball screws, which is housed inside a jacket or cover, which is preferably substantially cylindrical and composed of a plurality of modules which are coaxial with each other, at least two, and preferably three modules, which are also telescopic, comprising a first module which is rigidly connected to the fixed part 1, an end module which is connected to the movable plate 4 and any other intermediate modules, which are moved together with the end module, so as to perform a conventional driving movement upwards or downwards and vice versa or, alternatively, horizontally, by means of the system of telescopic screws, preferably of the recirculating ball type, which is coaxial with the jacket and which houses inside said telescopic screws a motor for providing movement. According to a preferred embodiment, the telescopic screw system according to the invention is based on a cascade connection of two or more recirculating ball screws, where the screws are hollow and provided with a recirculating ball system so that one screw forms simultaneously the female thread of another screw.

DESCRIPTION OF A PREFERRED EMBODIMENT OF THE INVENTION

With particular reference to the accompanying FIGS. 2-9, these show a preferred embodiment of the single-column trash compaction device according to the invention.

Said single-column device comprises a fixed part 1 having a shape suitable for connection to the structure of its housing, preferably a substantially parallelepiped shape (or cylindrical shape, not shown) with a quadrangular attachment plate 1*a* provided with fixing means 11 of the known type, for example screws, for fixing the single-column device to the structure designed to house it. In zone A in FIG. 5 and in the detail shown in FIG. 6 the fixed part 1 houses internally a top end-of-travel switch (not shown). This switch, which is of a type known per se, performs the function of defining the origin (or "zero point") for calculating the extension of the system and stopping the motor when the system has reached the starting position (otherwise the motor would tend to continue to cause rotation of the system).

The fixed part 1 is also in turn rigidly connected by means of fixing elements known per se, for example screws, to the outer module 3 which is fixed and does not move inside the device, as explained in detail below.

Moreover, the fixed part 1 freely houses one of the two ends of a first hollow telescopic screw 5, the other end being connected so as to cooperate with a second hollow telescopic screw 6, as specified below.

The movable compaction plate 4 is arranged opposite the fixed part 1 and is displaced (typically is raised and lowered, but may also move horizontally) inside a trash collection compartment (not shown) so as to perform compaction of the trash. Said movable plate 4 may have any shape, depending on the configuration of the trash container. Advantageously, it has a quadrangular shape provided with a top cover 4*a* which is fastened thereto by means of fixing systems 41, of the type known per se, for example screws.

Moreover, the movable plate 4 is in turn fastened, by means of fixing elements known per se, for example screws, to the end module 3", described in detail below. Said fixed part 1 and said movable plate 4 are connected together by means of a movement system of the recirculating-ball telescopic screw type, arranged at right angles to the fixed part 1 and to the movable plate 4 and able to displace the movable plate 4 vertically or horizontally. Said telescopic movement system is housed inside a jacket, also with the function of a cover, consisting of coaxial telescopic modules 3, 3', 3", the first loading module (module 3) being rigidly connected to the fixed part 1, the third end module (module 3") being rigidly connected to the movable plate 4, and the intermediate module 3' being slidable between the first module and third module. The module 3", in addition to forming a cover of the system, also and in particular has the function of assisting the movement of the plate 4 in order to compress the trash.

FIGS. 2-9 show the arrangement of the modules 3, 3' and 3" in which the module 3, connected to the fixed part 1, is positioned outermost with respect to said modules and the module 3", connected to the movable plate 4, is positioned innermost. However, according to an alternative and equivalent embodiment, the module connected to the fixed part 1 may be outermost and the module connected to the movable plate 4 may be innermost, with any intermediate modules moved by the driving movement between the outermost module and innermost module.

In the arrangement shown, the modules 3', 3" are moved with a conventional driving movement from the top downwards and vice versa (or horizontally) by the telescopic screw system, for example of the recirculating ball type, coaxial with the modules and housed inside the jacket or cover.

The system of telescopic screws shown in FIGS. 2-9 is of the recirculating-ball double telescopic screw type in which a first hollow screw 5 is rotated around the axis of the motor arranged inside it and coaxial therewith, as described in detail below.

Each screw also has the function of a female thread, since, having a bore and being threaded, it is able to receive another threaded element or device (for example a second hollow screw) which engages in or on its thread.

In this way the first hollow screw 5 is formed so as to have a suitably threaded outer surface and forms a female thread for a second hollow screw 6 which in turn rotates and is displaced and forms a female thread for the module 3" which therefore is displaced together with the movable plate 4.

The motor unit 2 is arranged inside the first hollow screw 5 and advantageously is inserted inside a housing 22 which is in turn rigidly connected, at the top thereof, to the feed part 1 and, at the bottom thereof, is fastened to the bottom part of the first hollow screw 5, for example by means of screws 2*a*. By means of the drive chain comprising gearwheels 21, the rotational movement of the motor is transferred to said first hollow screw 5 integrally, at its end part, as shown in detail in FIG. 7. The motor, during its movement, transmits the rotation to the first hollow screw 5 to which it is rigidly connected.

Figure 5:
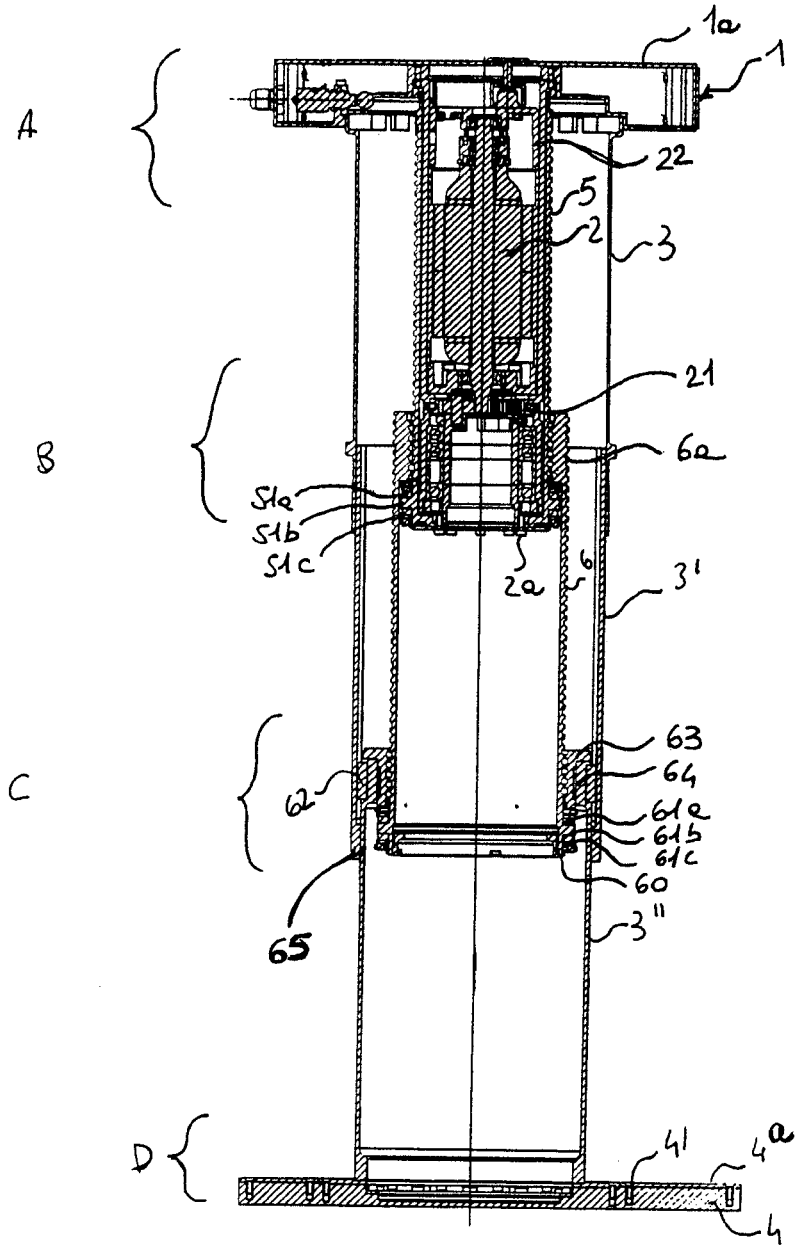
FIG. 5 is a cross-sectional view of FIG. 3.

This rotation causes the movement of the (recirculating) balls which are located in zones B and C shown in FIGS. 5, 7 and 8.

The second hollow screw 6 is formed so as to have a suitably threaded enter surface so as to travel on the outside of the first hollow screw 5. The top end 6*a* of said second hollow screw 6 is provided with a double ball-recirculating thread and is connected so as to cooperate with the first hollow screw 5 so that the two hollow screws 5 and 6 slide on top of each other (purpose of double thread), their relative movement being interrupted and/or limited by a series of mechanical stops which have the purpose of avoiding extraction of the moving parts and damping the knocks, thus reducing the wear and the reducing the contact noise. Said, mechanical stops are positioned at the bottom ends of the hollow screws 5 and 6, respectively, and advantageously comprise a set of annular flanges 51*a*, 51*b*, 51*c*, and 61*a*, 61*b*, 61*c* associated with the hollow screws 5 and 6, respectively. The annular flanges 51*a*, 51*b* and 51*c* of said first hollow screw 5 cooperate with the top end 6*a* of the second hollow screw 6.

The annular flanges 61*a*, 61*b* and 61*c* at the bottom end of said second hollow screw 6 cooperate with the top part 64 of the module 3" by means of a threaded ball-recirculating cage 63. The bottom part of the hollow screw 6 in turn terminates in the form of a stop flange 60 which forms an end-of-travel stop for the first hollow screw 5.

In turn the module 3' is structured so as to have an annular contact shoulder 65 which allows it to slide, assisted by spacing shims 62.

Operation

Operation of the device according to the invention during the compacting action starting from the rest position with the plate 4 raised is as follows (extension operation). The motor rotates integrally with the first hollow screw 5. The first hollow screw 5 in turn, by means of recirculation of balls present in zone B, allows rotary-translation, of the second hollow screw 6. At the same time the movement of the second hollow screw 6 allows translation of the stage 3" by means of a second recirculating-ball system which is positioned in the zone C. The module 3' is thus driven, by the shim elements 62, thus producing complete extension of the compactor.

The second hollow screw 6 completes its stroke when its top end 6*a* reaches the stop 51*a*, 51*b*, 51*c*, while it continues to rotate integrally with the first hollow screw 5 so as to allow the simultaneous displacement of the module 3" which moves until the threaded cage 63 reaches the stop 61*a*, 61*b*, 61*c*, displacement terminating against the stop 64.

During its movement in the opposite direction, the module 3" travels up along the second hollow screw 6 until the maximum reduction in length determined by contact with the stops 61*a*, 61*b*, 61*c* occurs; in turn the screw 6 travels back upwards over the screw 5, taking along with it the modules 3' and 3" as far as the stop 51*a*, 51*b*, 51*c*. When the completely closed position is reached, the switch is tripped and stops the motor.

Correct and efficient operation of the single-column compaction device is ensured by means of a control panel (not shown) which interfaces with an electronic section managed by a microprocessor with software. In this way it is possible to manage the various operative phases of the compactor, suitable coordinating the compaction functions. Moreover, on the control display it is possible to show information such as the number of cycles and the operating hours and/or other useful information for operation and maintenance of the compactor.

Control over operation of the compactor is furthermore ensured by means of the use of suitably positioned sensors which may be, for example of the microswitch, optical, magnetic or other type. These sensors allow activation of the compaction function to be adjusted and ensure operation of the machine in complete safety.

Advantageously, operation of the compactor is assisted by a sensor, for example of the inductive type, the purpose of which is to provide, by means of a pulse count, the extension length of the system during operation. This information is then sent to a display in real time in order to keep the operator informed of the activity. It also provides information about the quantity of garbage present inside the container.

Advantageously, the compactor according to the invention does not require additional electronic devices for the bottom end-of-travel stop since the end of travel of the system is ensured by mechanical stops which form an integral part of the design, and this constitutes a safety feature which is not present in the devices of the prior art.

The compactor according to the invention may be conveniently installed in suitable compartments, which are fixed or movable on wheels, such as a trolley, so as to allow easy displacement thereof inside the transportation means and insertion within the appropriate working spaces.

Figure 1B:
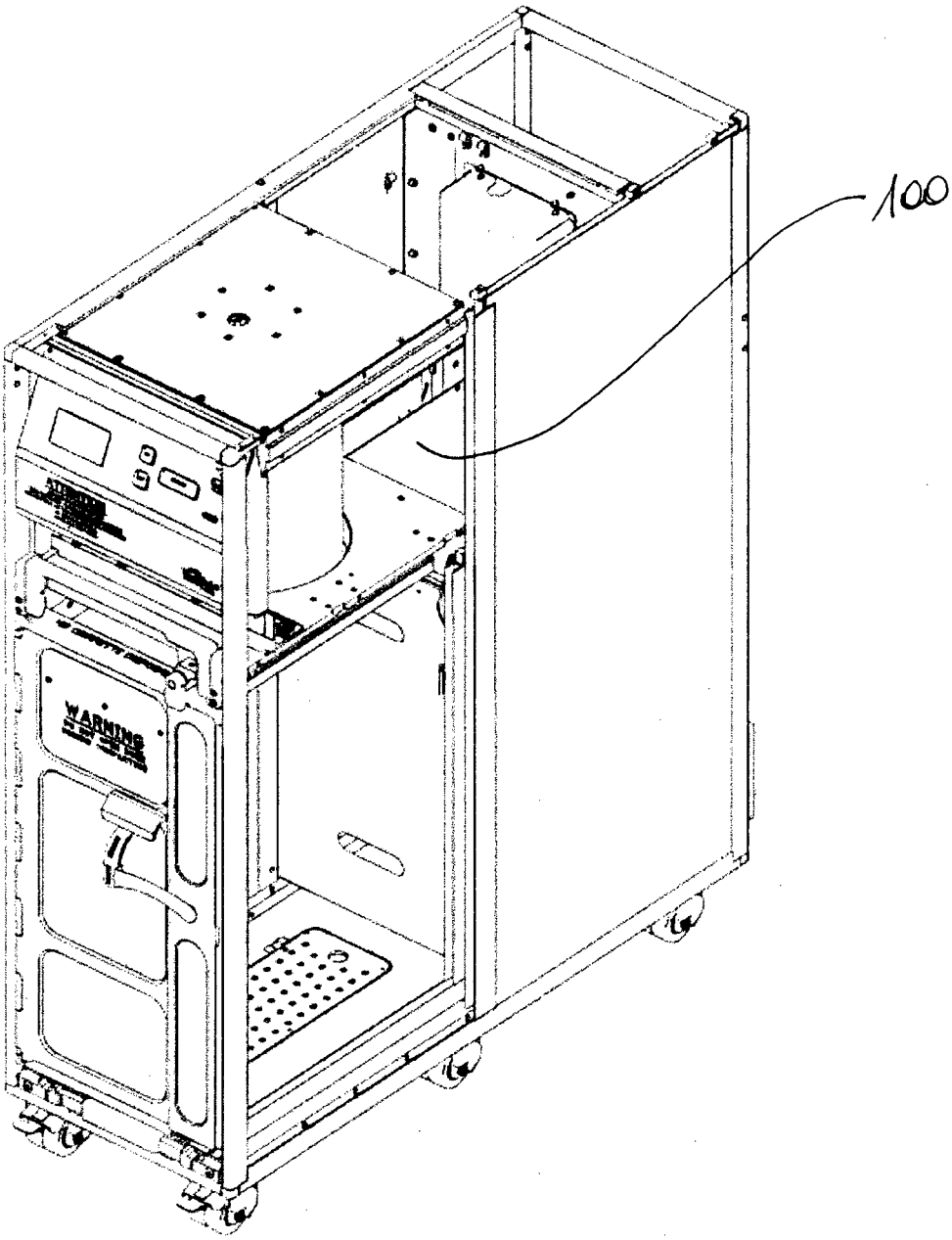
FIG. 1*b* is a schematic perspective view of a trolley used in aircraft, according to the prior art, inside which the single-column trash compaction device according to the invention may be inserted.
Figure 2:
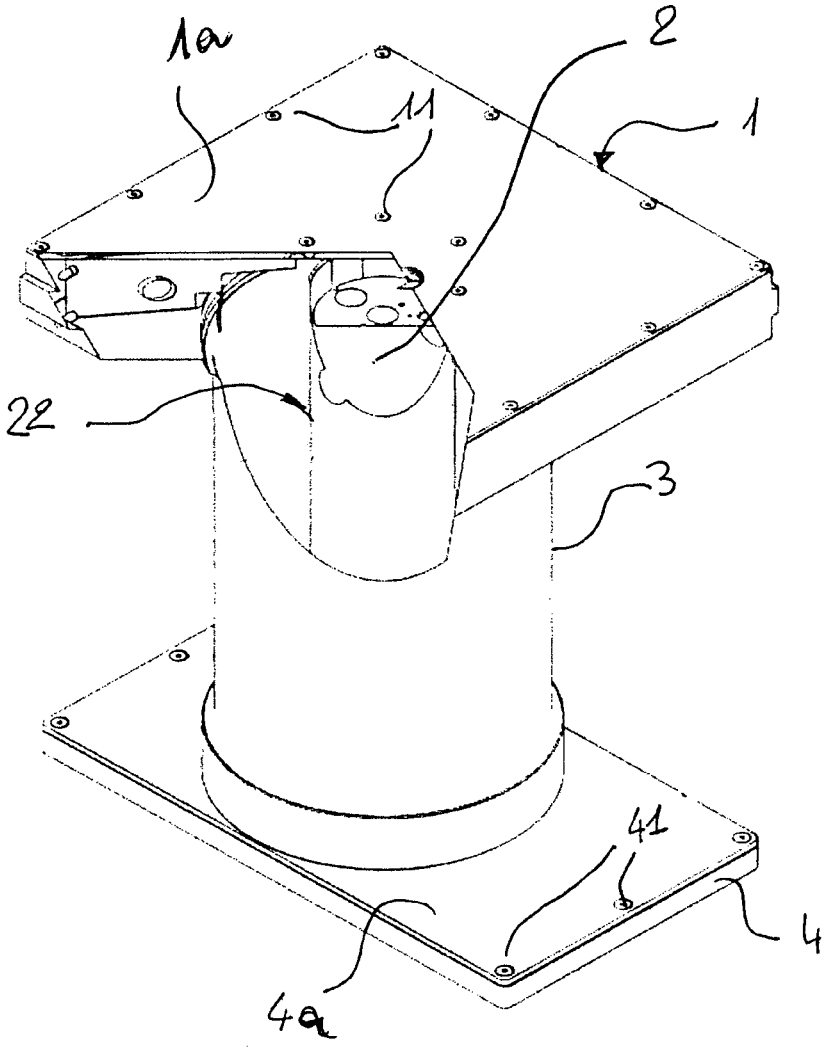
FIG. 2 is a partial, schematic, perspective view of the device according to the invention in which the compaction plate is completely raised, with part removed so that the motor housing is visile.
Figure 3:
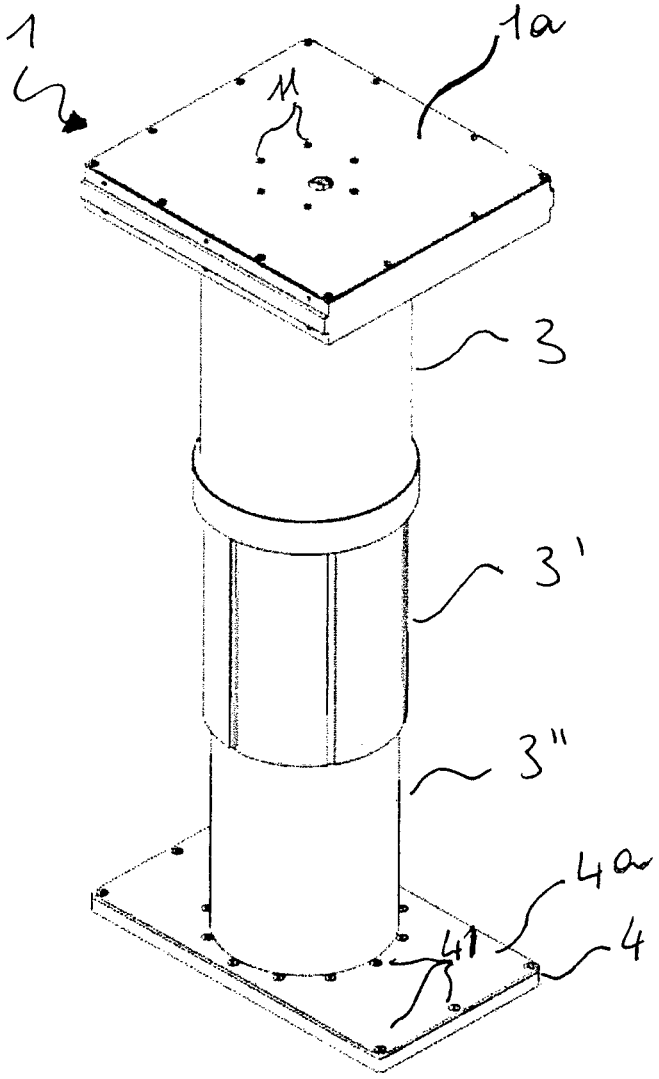
FIG. 3 is a partial, schematic, perspective view of the device according to FIG. 2, in which the compaction plate is completely lowered and the telescopic system is completely extended.
Figure 4:
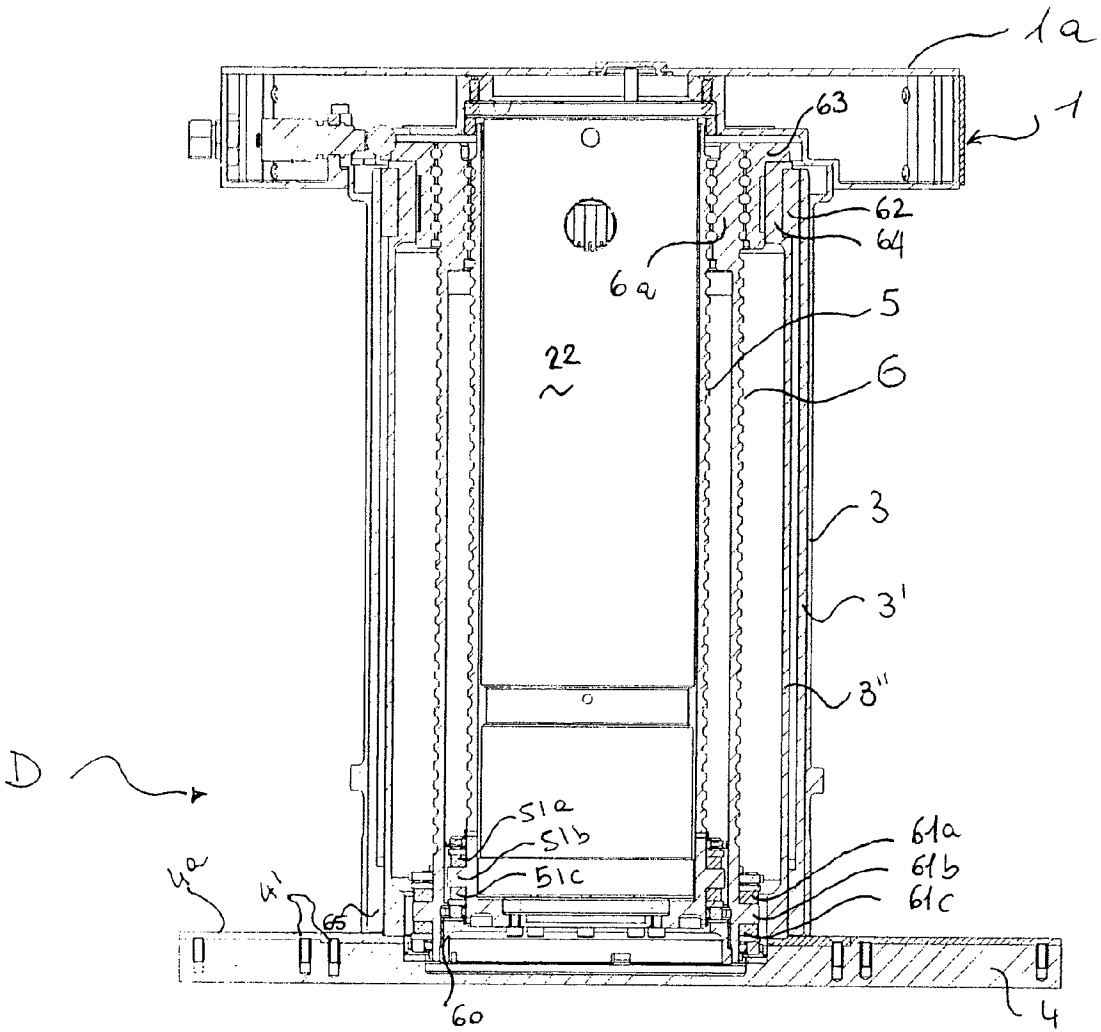
FIG. 4 is a cross-sectional view of FIG. 2.
Figure 4A:
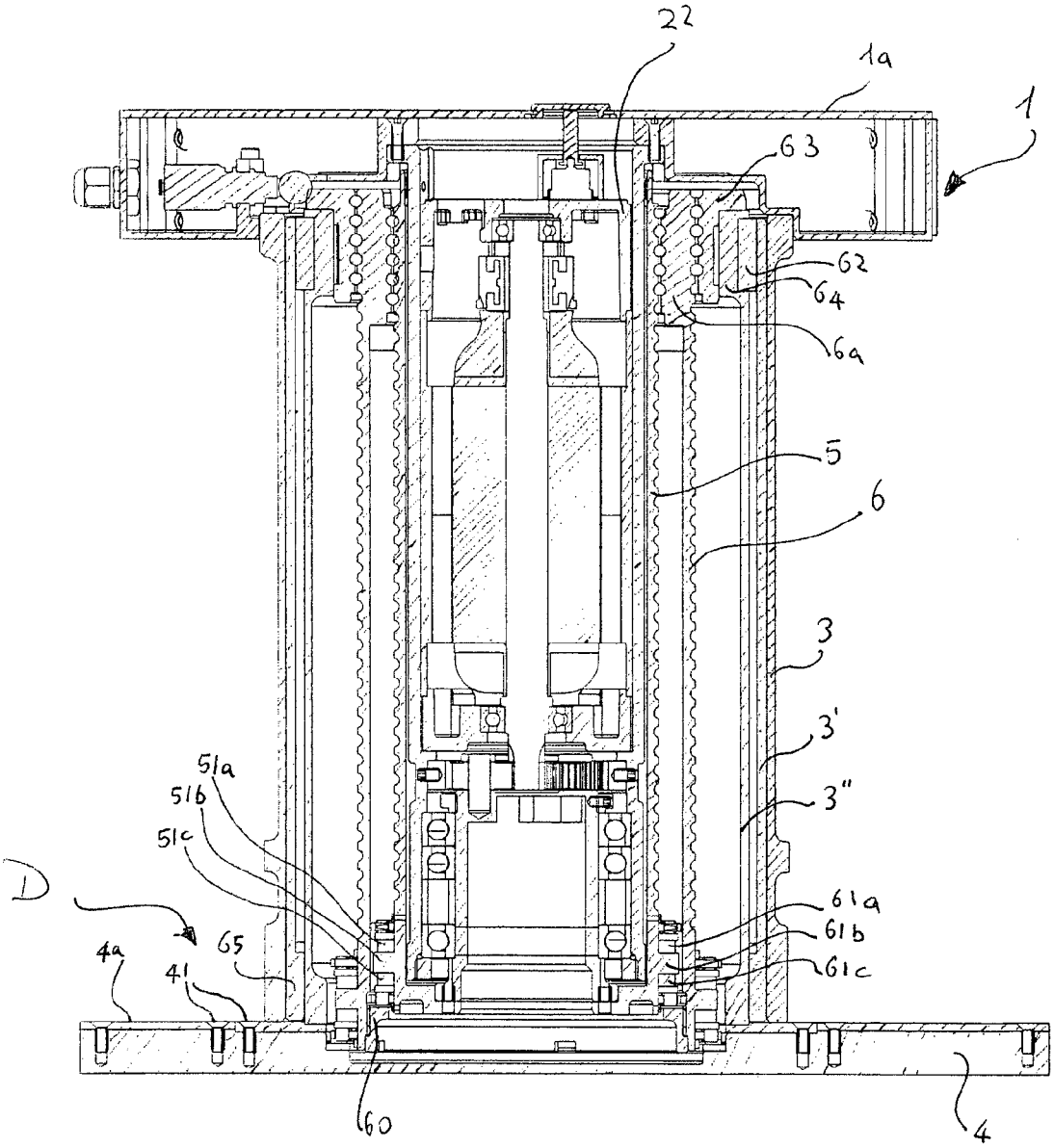
FIG. 4*a* is the same view as that of FIG. 4 with the housing 22 for the motor 2 removed.

FIG. 1*a* shows a trolley of the conventional type, for example of the type described in U.S. Pat. No. 7,089,862, which houses a conventional compactor inside the compartment 100. An advantage of the compactor according to the invention is that of being able to be housed inside the same compartment 100 of the trolley according to the prior art without the need for further adaptation, owing to its modular nature, as shown in FIG. 1*b*.

The compactor device according to the invention, owing to the combination of parts which form it, is very compact, modular, light and efficient from the point of view of consumption of electric power. It also complies with the existing aeronautical regulations.

The use of the single-column compactor device according to the invention is not limited, to use in the aeronautical sector, but may also be used on buses, trains, ships and other transportation means or is stationary locations such as homes, offices, hospitals, restaurants, hotels, canteens and in all those places where it is required to compact trash in a very small spaces.

The arrangement of the motor housed inside the telescopic screws (and not in the compaction system) results in undeniable improvements in terms of dimensions and functionality of the compactor according to the invention, not only because it is slimmer and less bulky, but also because it is protected during any maintenance operations and also can be assembled more easily in the event of replacement. It is sufficient in fact to unscrew a few screws and two connectors in order to perform replacement of the entire plate/cover/motor assembly very rapidly, with practically zero probability of alignment errors. On the other hand, the known devices, such as the double screw device, require at least separate removal and subsequent reinstallation of the motor, the plate and the cover on the screws, in addition to the need to synchronize the movements of the two screws.

The solution with the incorporated motor also ensures that the system requires less maintenance.

The absence of belts and pulleys, which are components prone to wear, also means that the maintenance of the compactor as a whole may be performed at longer intervals. In the aeronautical sector this advantage is even more appreciated since it results in periodic disembarking operations performed at longer time intervals, with consequent savings in terms of costs.

In the device according to the invention, the covers are formed by the covering jacket (modules 3, 3', 3"), are self-cleaning, namely even if dirt should accumulate on one of them the module which travels over it would clean it during operation since the relative mechanical dimensions of the modules are designed so as to perform this function.

The cover of the invention is formed by the (movable) element 3' and the (fixed) element 3 (FIG. 5) such that the basic dimensions are kept to the bare minimum. Moreover, the presence of the stage 3" also ensures that the entire system of screws is covered in the rest condition.

Unlike the conventional covers, the cover according to the invention does not allow the various stages to move autonomously until a mechanical stop is reached, which would result in the systems being noisy and without fluidity of movement.

The presence of mechanical stops on the screws moreover prevents possible damage to the screws owing to complete accidental unscrewing or deformations due to over-screwing.

The compactor according to the invention may be made using any material which has the necessary strength characteristics. In particular, for use in the aeronautical sector, light metal alloys, such as aluminum alloys or composite materials with a low inflammability and toxicity, known per se, are preferred.

Other advantages of the compactor relate to its maintenance since it does not require greasing, nor is it subject to soiling, even though devoid of a protective bellows, since the protective action in performed completely by the jacket. The effect of soiling on this system is less tangible since the outer protective jackets are such that, owing to the materials used and the geometric form, they ensure a better performance which results in routine maintenance at less frequent intervals than in the prior art (c.f. for example the bellows).

Other further advantages are as follows: very compact design; optimum movement at high and low feed speeds (settable via software); ease of operation, great efficiency and low heat production; smooth start-up and positioning; operation without play in the case of tensile or compressive loads; extremely high rigidity; precise positioning to within a mm. Optimization of the geometrical forms and the technical/manufacturing precision, which are also clue to the linear and uniform recirculation and return movement of the ball train, result in regular and silent travel at any speed and a high compression efficiency.

The compactor makes efficient use of the power of the motor so that it is able to develop high compression forces also with low-power motors with optimization also of the mechanical thrust, namely improved stress resistance.

Advantageously, operation of the compactor is not limited by its positioning since the plate is able to accomplish its functionality downwards, upwards and horizontally.

The particular embodiment described here does not limit the content of this application which covers all the variants of the invention defined by the claims.

The invention claimed is:

1. A single-column trash compactor device comprising:

a fixed part (1) attached to a structure, and a movable compaction plate (4) housed in a housing;

a multiple-stage telescopic screw system configured to move the movable compaction plate (4) toward the fixed part (1) within the housing; and a motor (2) for moving the movable compaction plate toward the fixed part (1), wherein the fixed part (1) is connected to the movable compaction plate (4) by the multiple-stage telescopic screw system, wherein the multiple-stage telescopic screw system is housed in a jacket or a cover and comprises three coaxial telescopic modules (3, 3', 3"), wherein a first coaxial telescopic module (3) is rigidly connected to the fixed part (1), a third coaxial telescopic module (3") is rigidly connected to the movable compaction plate (4), and a second coaxial telescopic module (3') is slidable between the first coaxial telescopic module (3) and the third coaxial telescopic module (3"), and the first coaxial telescopic module (3) comprises a first telescopic screw (5), the second coaxial telescopic module (3) comprises a second telescopic screw (6), and the first telescopic screw (5) is threadedly connected to the second telescopic screw (6), and the first telescopic screw (5) has the motor (2) housed within to which it is rigidly connected, and the motor is housed inside the three coaxial telescopic modules when the three coaxial telescopic modules are in a retracted position, wherein the motor is capable of rotational movement for moving the threadedly connected telescopic screws such that the movable compaction plate (4) moves toward the fixed part (1).

2. The single-column trash compactor device of claim 1, wherein the telescopic screws are recirculating-ball telescopic screws.

3. The single-column trash compactor device of claim 1, wherein the movable plate (4) and the third coaxial telescopic module (3") can be moved together by a vertical or a horizontal driving movement generated by the motor of the multiple-stage telescopic screw system.

4. The single-column trash compactor device of claim 1, wherein the first telescopic screw (5) is a first hollow telescopic screw and the second telescopic screw (6) is a second hollow telescopic screw, and the first hollow telescopic screw (5) forms the female thread of the second hollow telescopic screw (6), which in turn forms a female thread for the third module (3").

5. The single-column trash compactor device of claim 4, wherein the first hollow telescopic screw (5) and the second telescopic hollow screw (6) each comprise mechanical stops (51*a*), (51*b*) and (51*c*) and (61*a*), (61*b*) and (61*c*).

6. The single-column trash compactor device of claim 4, wherein the second hollow telescopic screw (6) has a top end (6*a*) with a double thread and a bottom end with a threaded cage (63).

7. The single-column trash compactor device of claim 4, wherein the motor (2) is arranged inside the first hollow telescopic screw (5) and is rigidly connected at the top thereof to the fixed part (1).

8. The single-column trash compactor device of claim 1, wherein the second telescopic module is structured to have an annular contact shoulder (65) and spacing shims (62).

9. The single-column trash compactor device of claim 1, further comprising electronic components for controlling the movement of the movable compaction plate (4).

10. An assembly comprising: (a) a single-column trash compactor device and (b) a compartment for collecting trash to be compacted, wherein the single-column trash compactor device comprises:

a fixed part (1) attached to a structure, and a movable compaction plate (4) housed in a housing;

a multiple-stage telescopic screw system configured to move the movable compaction plate (4) toward the fixed part (1) within the housing; and a motor (2) for moving the movable compaction plate toward the fixed part (1), wherein the fixed part (1) is connected to the movable compaction plate (4) by the multiple-stage telescopic screw system, wherein the multiple-stage telescopic screw system is housed in a jacket or a cover and comprises three coaxial telescopic modules (3, 3', 3"), wherein a first coaxial telescopic module (3) is rigidly connected to the fixed part (1), a third coaxial telescopic module (3") is rigidly connected to the movable compaction plate (4), and a second coaxial telescopic module (3') is slidable between the first coaxial telescopic module (3) and the third coaxial telescopic module (3"), and the first coaxial telescopic module (3) comprises a first telescopic screw (5), the second coaxial telescopic module (3) comprises a second telescopic screw (6), and the first telescopic screw (5) is threadedly connected to the second telescopic screw (6), and the first telescopic screw (5) has the motor (2) housed within to which it is rigidly connected, and the motor is housed inside the three coaxial telescopic modules when the three coaxial telescopic modules are in a retracted position, wherein the motor is capable of rotational movement for moving the threadedly connected telescopic screws such that the movable compaction plate (4) moves toward the fixed part (1).

11. A carrying structure comprising: (a) a single-column trash compactor device and (b) a housing, wherein the single-column trash compactor device comprises:

a fixed part (1) attached to a structure, and a movable compaction plate (4) housed in the housing;

a multiple-stage telescopic screw system configured to move the movable compaction plate (4) toward the fixed part (1) within the housing; and a motor (2) for moving the movable compaction plate toward the fixed part (1), wherein the fixed part (1) is connected to the movable compaction plate (4) by the multiple-stage telescopic screw system, wherein the multiple-stage telescopic screw system is housed in a jacket or a cover and comprises three coaxial telescopic modules (3, 3', 3"), wherein a first coaxial telescopic module (3) is rigidly connected to the fixed part (1), a third coaxial telescopic module (3") is rigidly connected to the movable compaction plate (4), and a second coaxial telescopic module (3') is slidable between the first coaxial telescopic module (3) and the third coaxial telescopic module (3"), and the first coaxial telescopic module (3) comprises a first telescopic screw (5), the second coaxial telescopic module (3) comprises a second telescopic screw (6), and the first telescopic screw (5) is threadedly connected to the second telescopic screw (6), and the first telescopic screw (5) has the motor (2) housed within to which it is rigidly connected, and the motor is housed inside the three coaxial telescopic modules when the three coaxial telescopic modules are in a retracted position, wherein the motor is capable of rotational movement for moving the threadedly connected telescopic screws such that the movable compaction plate (4) moves toward the fixed part (1).

12. A trolley or a wheeled compartment comprising: (a) a single-column trash compactor device and (b) a wheeled compartment housing, wherein the single-column trash compactor device comprises:

a fixed part (1) attached to a structure, and a movable compaction plate (4) housed in the housing;

a multiple-stage telescopic screw system configured to move the movable compaction plate (4) toward the fixed part (1) within the housing; and a motor (2) for moving the movable compaction plate toward the fixed part (1), wherein the fixed part (1) is connected to the movable compaction plate (4) by the multiple-stage telescopic screw system, wherein the multiple-stage telescopic screw system is housed in a jacket or a cover and comprises three coaxial telescopic modules (3, 3', 3"), wherein a first coaxial telescopic module (3) is rigidly connected to the fixed part (1), a third coaxial telescopic module (3") is rigidly connected to the movable compaction plate (4), and a second coaxial telescopic module (3') is slidable between the first coaxial telescopic module (3) and the third coaxial telescopic module (3"), and the first coaxial telescopic module (3) comprises a first telescopic screw (5), the second coaxial telescopic module (3) comprises a second telescopic screw (6), and the first telescopic screw (5) is threadedly connected to the second telescopic screw (6), and the first telescopic screw (5) has the motor (2) housed within to which it is rigidly connected, and the motor is housed inside the three coaxial telescopic modules when the three coaxial telescopic modules are in a retracted position, wherein the motor is capable of rotational movement for moving the threadedly connected telescopic screws such that the movable compaction plate (4) moves toward the fixed part (1).

13. The single-column trash compactor device of claim 1, wherein the housing has a substantially parallelepiped shape or a cylindrical shape.

14. The single-column trash compactor device of claim 1, wherein the housing is a trash collection compartment.

15. The single-column trash compactor device of claim 1, wherein the housing is positioned vertically or horizontally in the device.

16. The single-column trash compactor device of claim 1, further comprising a mechanical stop to stop movement of the movable compaction plate (4).

17. The single-column trash compactor device of claim 1, wherein the device is made using components comprising an aluminum alloy or a composite material with a low inflammability or a low toxicity.

18. The single-column trash compactor device of claim 1, wherein the motor is capable of rotational movement, and the motor comprises a drive chain comprising gearwheels (21) rotated by the rotational movement of the motor, and the rotational movement of the gearwheel is transmitted to at least one telescopic screw.

* * * * *